United States Patent [19]

Shaw et al.

[11] Patent Number: 4,470,582

[45] Date of Patent: Sep. 11, 1984

[54] INTRODUCTION OF SUBSTANCES INTO MOLTEN METAL

[75] Inventors: Richard D. Shaw; Richard P. B. Davis, both of Bromley, England

[73] Assignee: Zirconal Processes Limited, Bromley, England

[21] Appl. No.: 465,552

[22] Filed: Feb. 10, 1983

[30] Foreign Application Priority Data

Feb. 15, 1982 [GB] United Kingdom ..... 8204337
Apr. 1, 1982 [GB] United Kingdom ..... 8209724

[51] Int. Cl.[3] ..... C21B 7/16

[52] U.S. Cl. ..... 266/266; 75/53; 75/58; 75/60; 75/130 BB

[58] Field of Search ..... 75/51-60, 75/130 BB; 266/266

[56] References Cited

U.S. PATENT DOCUMENTS 4,093,452 6/1978 Spenceley ..... 75/60
4,232,854 11/1980 Barbakadze ..... 75/53
4,308,057 12/1981 Ono ..... 75/59

*Primary Examiner*—Peter D. Rosenberg
*Attorney, Agent, or Firm*—Christensen, O'Connor, Johnson & Kindness

[57] ABSTRACT

A valve assembly for insertion into the bottom of a ladle for molten metal comprises refractory upper and lower parts defining a flow passage with an enlarged central region containing a valve head. The valve head is moved by a spindle to control the flow of gas injected through the valve into the metal.

5 Claims, 1 Drawing Figure

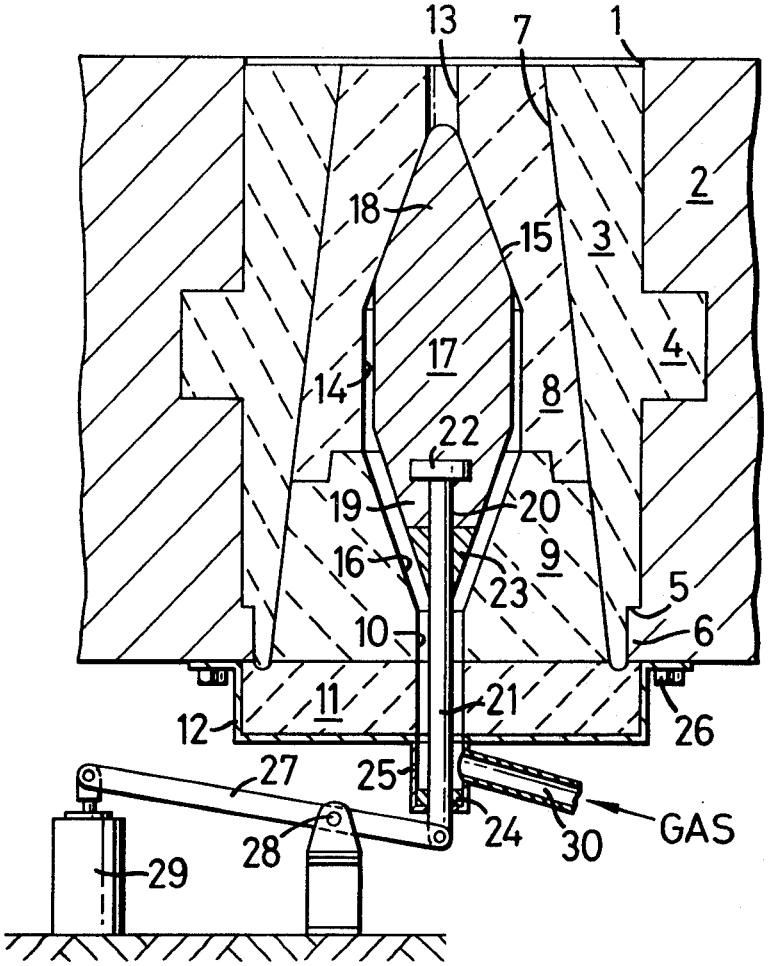
13
7
1
2
18
15
3
4
17
14
8
22
19
20
16
9
23
5
10
6
11
21
12
26
27
25
24
30
GAS
28
29

INTRODUCTION OF SUBSTANCES INTO MOLTEN METAL

This invention is concerned with the introduction of substances into molten metal. The invention is particularly concerned with procedures wherein a powdered solid is carried by a gas stream into the molten metal. An example of such a procedure is the injection of calcium silicide into molten steel.

Procedures at present in use involve the use of an elongate tube, known as a lance which is usually fabricated prior to use from refractory parts. Lances are subjected to considerable wear, abrasion damage and slag attack and their life is limited even though they may only be immersed in the molten steel and slag for very short periods.

According to one aspect of the present invention there is provided a method of introducing a gaseous stream into a container of molten material, such method comprising the steps of causing the stream to flow under pressure into an entry passage in the container wall and operating a valve to open the passage to allow the gas stream to enter the molten metal.

The gas stream may have entrained in it an active substance in powder form. Thus an argon gas stream may carry calcium silicide as, inter alia, a desulphuriser. As another example an argon or other inert gas stream could carry lime.

Perferably the valve will be adjustably openable so as to vary the cross-sectional area of the flow passage and regulate the gas flow rate.

Conveniently the passage and the valve are defined in a separately formed refractory structure and in accordance with a further aspect of the invention there is provided a valve assembly dimensioned to fit an opening in the lower part of the container and defining the entry passage with a valve member for closing the passage and means for moving the valve member into and away from the open position to close and open the passage.

In an embodiment the flow passage has an enlarged region with an upper valve seating against which the valve moves to open and close the flow passage. In accordance with a further and preferred feature of the invention a further seating is provided in the lower part of the enlarged region. If gas flow ceases when the valve is opened the head of molten metal causes the valve to seat in the lower seating to close the flow passage.

The accompanying sectional drawing illustrates a valve assembly in accordance with the present invention in position in the base of a ladle for molten metal.

Referring to the drawing an opening 1 in the lower part 2 of a ladle for molten metal is lined by a generally cylindrical block 3, a refractory well block, having a retaining rim 4 and rebate 5 in the lower part supported by an inwardly directed ledge 6 of the metal ladle base. The well block 3 has a frusto-conical through socket 7 in which is located the frusto-conical refractory casing of a valve assembly in accordance with the invention. The casing comprises upper and lower generally frusto-conical separately formed parts 8 and 9 with complementary stepped mating surfaces. The lower part 9 has a relatively wide passage 10, vertically disposed in use, and a lower surface resting, through the intermediary of a refractory ring 11 on an inwardly extending metal support canister 12 secured to the ladle by bolts 2*b*. The upper part 8 has a narrower vertical passage 13. The valve assembly may be contained for convenience of installation and handling in a metal outer shell.

The passage 10 and 13 are widened in their facing regions so as to define a chamber 14 with frusto-conical upper and lower parts 15, 16 respectively defining upper and lower sockets constituting valve seatings.

The valve member or head is an elongate refractory piece with a central cylindrical region 17 and upper and lower conically tapered valve parts 18 and 19. The lower part 19 has a keyway 20 to allow sliding entry of the enlarged head 22 of a valve spindle 21. On sliding insertion the spindle is turned through 90° into the locating slot in the position illustrated. A retaining nut 23 screwed onto the spindle 21 locks the valve head. The valve head is shown in the upper closed position seated in the upper conical seat 15 and closing the passageway 10, 13. To open the valve fully the spindle and head are retracted to a position such that the distances between adjacent walls of valve head and the upper and lower seatings respectively is equal. The spindle movement to achieve this is approximately 2.5 cm.

The spindle 21 extends rearwardly through a bearing seal 24 which, together with a downward extension 25 of the canister 12 closes the rear of the passage 10, 13 to a pivotal connection to one end of an actuating lever 27 fulcrummed at 28 and having the other end thereof pivotally connected to a hydraulic or other ram 29. An upwardly inclined inlet passage 30 is provided above bearing seal 24 to the source of gas and entrained substance.

In use in the position illustrated, the gas stream with the entrained substance, for example argon with calcium silicide, is initiated. The valve head on the spindle is moved rearwardly to an open position so that gas flow is permitted through both upper and lower valve seats. The amount of opening is continuously adjustable so precise control of gas flow can be achieved. The gas and the intrained substance thus is injected under pressure into the molten contents of the ladle. After injection the valve is moved forwardly to the closed position and the supply of gas then terminated. It will be appreciated that the forward gas stream in the passage prevents molten metal escaping rearwardly. Thus the gas will be injected at a pressure sufficient to overcome the static head of molten metal in the ladle and to ensure mixing of the stream with the metal. Pressures of 4–8 atmospheres are often used. The valve head may be spring biassed to the open or closed position. In the event that rearward forces are developed sufficient to override the ram and any spring bias so that the valve head moves rearwardly an emergency seating of lower valve part 19 on the lower valve seat 16 is achieved thereby closing the passage 10.

Parts characterised as "refractory", for example, the parts 8 and 9 are preferably cast from suitable refractory slurries based on refractory aggregates. Alumina based refractions are suitable as they have a good resistance to thermal shock. Any refractory however suitable for the environment of molten metal may be used.

In an alternative construction the spindle 21 has longitudinally extending ribs so as to fit and be guided by the passage 10. The gas then flows in the grooves between the ribs. Means such as hooks or bolts may be provided to fix the well block 4 against forward movement. Active material, for example in the form of a wire may be fed through a bore in the spindle and valve to emerge in the passage 13 to enter the ladle with the gas stream.

We claim:

1. A valve apparatus for controlling the flow of a gaseous stream having a powdered solid entrained therein into a container of molten metal, said apparatus comprising a refractory casing dimensioned to fit an opening in the lower part of the container, an entry passage within the casing, an enlarged region in the passage defining a front valve seating to regulate the gas flow and a rear valve seating to close the passage, a valve member with front and rear valve formations constructed to cooperate respectively with the front and rear seatings, and means for moving the valve member to open the front seating to commence and control the gas flow, said valve member being constructed and arranged so that rearward flow of molten metal through the passageway moves the valve member rearwardly to close the rear seating in the event that gas pressure in said passage falls below the static pressure of the molten metal when the front seating is open.

2. Apparatus according to claim 1, wherein the front and rear valve formations are tapered conical parts and the front and rear valve seatings are of corresponding tapered form.

3. Apparatus as claimed in claim 1 wherein the passage with an enlarged region defining the valve seat(s) is defined between upper and lower separately formed blocks of refractory material.

4. Apparatus according to claim 1 wherein the valve member is carried on the end of a reciprocable spindle operable from outside the passage.

5. Apparatus according to claim 1 wherein the spindle is surrounded with annular spacing by the passage and a side port in a rearward extension of the passage provides entry for the gas stream.

* * * * *